US006110027A

United States Patent [19]

Müller

[11] Patent Number: 6,110,027

[45] Date of Patent: Aug. 29, 2000

[54] GRINDING BODY AND A FASTENING DEVICE

[75] Inventor: Patrick Müller, Herdern, Switzerland

[73] Assignee: SIA Schweizer Schleif, Frauenfeld, Switzerland

[21] Appl. No.: 09/173,673

[22] Filed: Oct. 16, 1998

[30] Foreign Application Priority Data

Oct. 24, 1997 [CH] Switzerland ..... 2475/97

[51] Int. Cl.[7] ..... B24B 23/00

[52] U.S. Cl. ..... 451/359; 451/358; 451/342; 451/541; 451/548

[58] Field of Search ..... 451/342, 359, 451/360, 451, 452, 454, 455, 541, 508, 509, 510, 526, 529, 548

[56] References Cited

U.S. PATENT DOCUMENTS

| | | | |
|---|---|---|---|
| 2,469,624 | 5/1949 | Arnhart | 451/452 |
| 3,811,233 | 5/1974 | Eby | 451/452 |
| 5,595,532 | 1/1997 | McCracken | 451/451 |
| 5,709,597 | 1/1998 | Sarantits | 451/451 |

FOREIGN PATENT DOCUMENTS 2-15979 5/1988 Japan .

*Primary Examiner*—M. Rachuba
*Attorney, Agent, or Firm*—Shoemaker and Mattare

[57] ABSTRACT

An grinding body includes an annular carrier element. Grinding blades are arranged on both sides of the carrier element in a fan-like manner, the blades being overlapped in opposite directions on opposite sides of the carrier element. One side of the body is covered by a shield which forms part of a retainer for securing the body to a grinder.

6 Claims, 3 Drawing Sheets

GRINDING BODY AND A FASTENING DEVICE

BACKGROUND OF THE INVENTION

The invention relates to a grinding body with overlapping grinding blades which are arranged in a fan-like manner on a carrier element, according to the preamble of claim 1. Furthermore it relates to a fastening device for annular grinding bodies with a grinding surface arranged on a carrier element, according to the preamble of claims 8 and 9. Such grinding bodies have been sold and manufactured for a long time.

An example of the grinding bodies known in this manner until now consists of a plastic carrier element in the form of a disk on which individual grinding blades are mounted in a fan-like manner and overlappingly in the complete shape of a ring. The carrier element with the exception of a hole in the centre of the disk, which serves the fastening of the grinding disk to the grinding machine, is formed continuously. The carrier element with regard to its shape is only adapted to the outer diameter of the ring formed by the grinding blades.

The fan-like arrangement of the grinding blades serves for a self renewal of the abrasive. With a wearing away of the uppermost layer the abrasive of the blade lying thereunder becomes effective. This arrangement ensures a constantly high abrasion performance of the grinding disk. Up to the complete wearing away of the abrasive of all blades, a constant surface quality of the subject may be achieved. The special blade construction provides for a cool and dampened grinding and by way of this prevents a tarnishing of the surface of the subject.

Furthermore in JP 02015979 there is described a grinding body which consists of a carrier element in the form of a disk on which individual grinding blades are arranged in a fan-like manner and overlappingly in the form of a ring on both sides of the carrier element. The fan-like layering of the grinding blades are arranged on both sides of the grinding body and run in the same direction, i.e. the layering of the grinding blades is in the same direction. This same directional alignment permits an equally machining of two oppositely lying sides of a channel, furrow or groove. At the same time disadvantages of this grinding body are the existing danger of injury by way of radially accelerated abrasion from the subject, and its low life expectancy.

SUMMARY OF THE INVENTION

It is the object of the present invention to reduce the consumption of material for the manufacture of the carrier element with a simultaneous increase in the life expectancy of the grinding body without losing the good grinding properties of the already known design.

A further object lies in the manufacture of a fastening device for annularly formed grinding bodies independently of the construction of their grinding surface.

Furthermore the safety during the machining of subjects with such grinding bodies is to be considerably increased.

These objects are solved by the characterising parts of the independent patent claims 1, 8 and 9.

The invention provides for the manufacture of grinding bodies with which the overlappingly, fan-like arranged grinding blades are fastened on both sides of the same carrier element in oppositely directed layering for forming a grinding surface. Since the drive motors common for this type of grinding body only have one direction of rotation the oppositely directed layering of the grinding blades permits the subsequent or alternate use of both grinding surfaces with one and the same drive motor, which leads to a considerable increase in the life expectancy of the grinding body. The drive motors generally used in practice for this type of grinding body are angular grinding machines.

A reduction of the carrier element material consumption is achieved in that the shape of the carrier element essentially corresponds to the grinding surfaces which are formed by the overlappingly, fan-like arranged grinding blades. With this quasi adaptation of the carrier element to the whole shape of the grinding surface, no superfluous regions on the carrier element arrises which are not covered by grinding blades. For fastening the grinding body to a grinding machine there serves a fastening device which, with specially designed reliefs in the grinding body, is to be releasably engaged.

A preferred embodiment at the present invention is the formation of the carrier element and the grinding surface formed by the overlappingly, fan-like arranged grinding blades as a ring.

If in a further embodiment, the grinding body with the end face side of the fastening device forms a continuous disk, then a high user friendliness is obtained with respect to the assembly by mechanical tools.

Protective precautions for the side of the grinding body which faces the user and which is covered with grinding blades considerably increase the safety for the user. According to the invention this is realised in that together with the fastening device a protective covering is attached which completely covers the side of the grinding body facing the machine.

In a further embodiment this fastening device is two-part. The design is effected in the form of two retaining elements which fix the carrier element in a non-positive fitting manner by assembly by way of e.g. screws and which releasably close between themselves, in possible combination with positive fitting elements which firmly hold the carrier element in an unmovable position also without final fixation.

Realised with the present invention is furthermore a fastening device for annular grinding bodies with grinding surfaces arranged on both sides on a carrier element. The fastening device is advantageously realised by two retaining elements which are releasably connected to one another and which enclose the grinding ring with a non-positive fit and/or a positive fit, wherein one of the two retaining elements may be unreleasably connected to the protective covering. The connection of the retaining element and protective covering in a further embodiment form is releasably connected in two parts.

The grinding body realised with the present invention, which has particular advantages with respect to the material saving and disposal, can be further optimised by the complete new conception of the whole system (grinding device and fastening device). The concept of the lowest possible material expense was consistently continued with the exchangeable fastening device. With the fastening of grinding blades on both sides on the carrier element, is contrast to the state of the art there is integrated a protective device for the side of the grinding body, which faces the grinding machine. This function according to the invention is realised together with the developed fastening device.

BRIEF DESCRIPTION OF THE DRAWINGS

The invention is hereinafter described in more detail in embodiment examples by way of the drawings. There are shown.

DESCRIPTION OF THE PREFERRED EMBODIMENT

Figure 1:
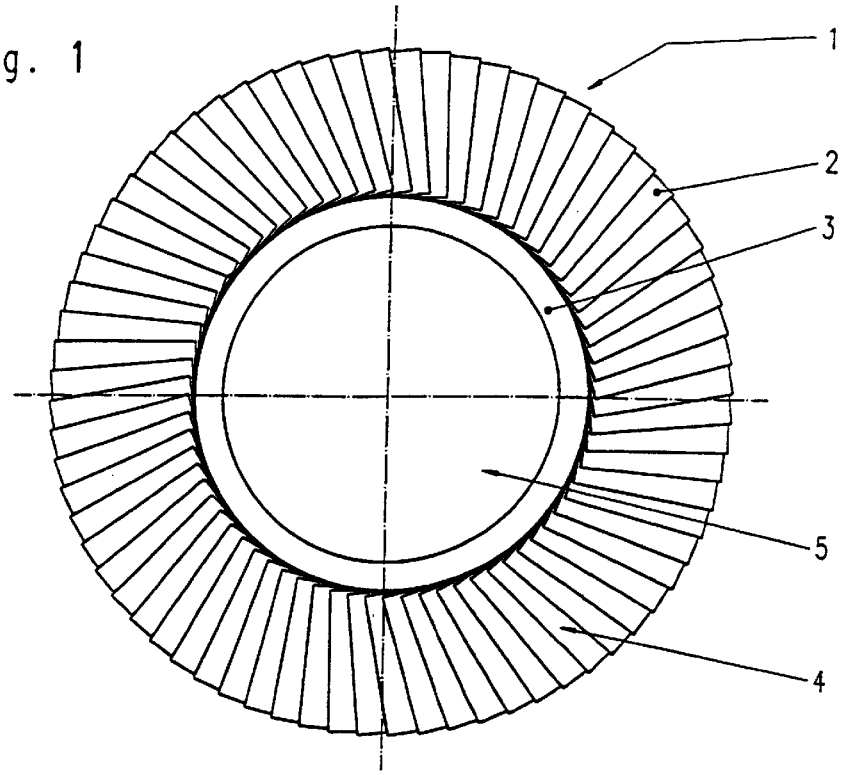
FIG. 1 the schematic representation of the grinding body according to the invention in the special embodiment form of a ring, in a plan view, FIG. 2 the grinding ring shown in FIG. 1 with a fastening device and an integrated protective covering in an exploded view, FIG. 3 an enlarged cutout of the grinding ring with a fastening device from FIG. 2, in cross section, FIG. 4 a cross section through the grinding body and a further two-piece embodiment form of the fastening device, FIG. 5 a grinding body and fastening device with a separate protective covering, in cross section.
Figure 2:
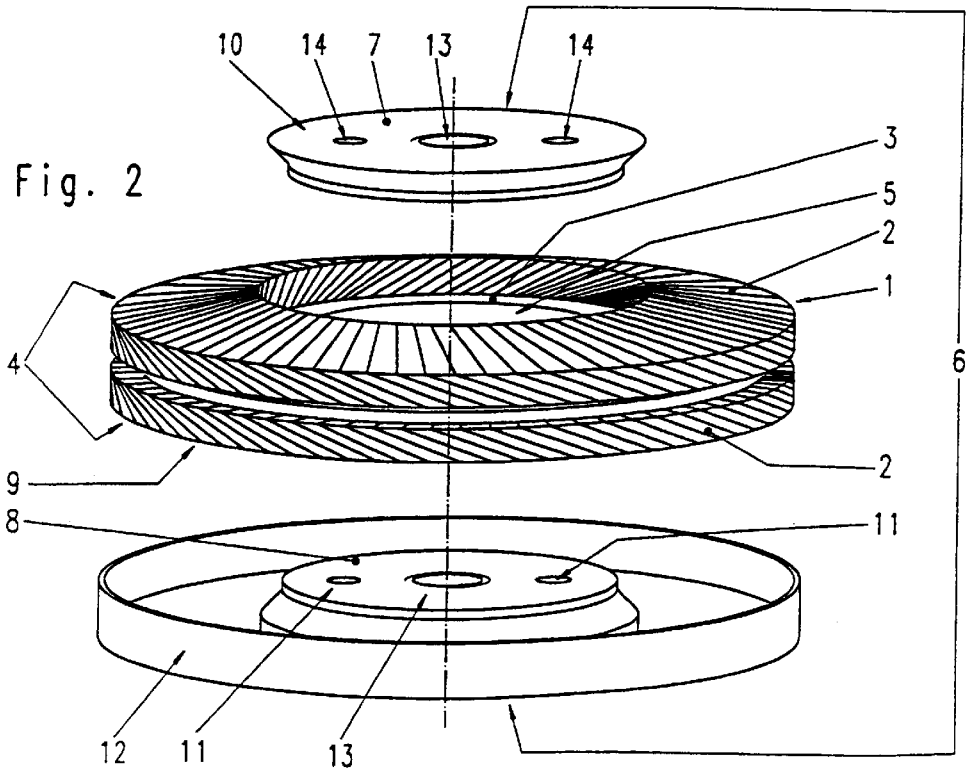
Figure 3:
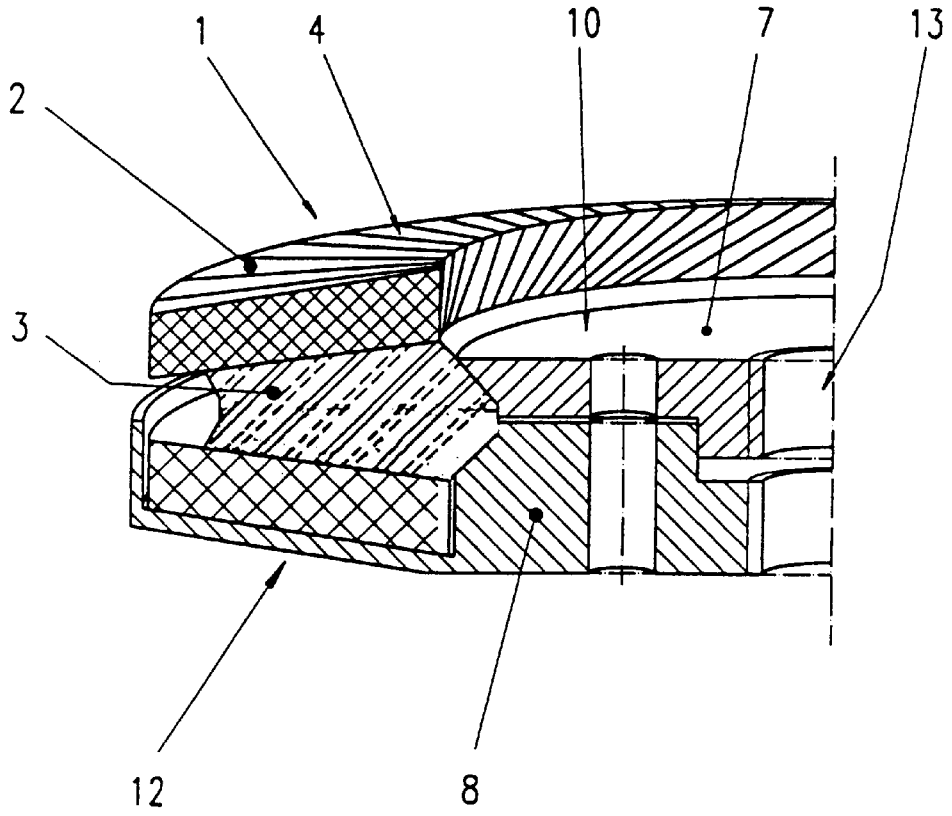

According to FIGS. 1 to 3 the grinding body 1 according to the invention comprises on both sides fan-like, overlappingly arranged grinding blades 2 which are fastened on a carrier element 3. In FIG. 2 the oppositely directed layering of the grinding blades 2 is shown. This oppositely directed layering leads to the formation of two grinding surfaces 4 which alternatively can be used with the same drive motor. The carrier element 3 in the shown, special embodiment form is formed as an annular body with an outer diameter of 115 mm and an inner diameter of 57 mm. These dimensions however in no way represent a limitation. The disk may be manufactured in any diameter. The most frequent outer diameter apart from 115 mm is 100 mm, 125 mm and 180 mm. On this carrier element 3 a grinding surface 4 is formed by 72 rectangular grinding blades 2, which comprise dimensions of 17 mm by 24 mm, wherein the overlapping is formed to an extent that roughly 5 mm of grinding surface per grinding blade is not covered by the next grinding blade lying thereover. Also on this occasion the mentioned dimensions of the grinding blades do not represent a limitation. The shape and dimensions are directed to the purpose of application and the size of the grinding body. The dimensions of the thus formed annular grinding surface 4 is 115 mm in outer diameter and 65 mm in inner diameter. The grinding blades 2 in the shown special embodiment form are adhesed on. Alternatively however it is also possible to fasten the grinding blades mechanically or in another manner, e.g. to manufacture the carrier element 3 with the injection moulding method and at the same time to simultaneously fasten the grinding blades. The carrier element 3 may consist of a material other than plastic, e.g. of metal, metal alloys, or any other material suitable for this purpose. The relief 5 formed by the annular formation of the grinding body 1, as can be deduced from FIG. 2, serves the accommodation of the fastening device 6.

The shown fastening device 6 consists of two retaining elements 7 and 8, wherein the retaining element 7 as an end face 10 of the fastening device 6 forms a surface with the grinding body 1. The other retaining element 8 in the special case is unreleasably connected to a protective covering 12 for the side 9 of the grinding body 1, which faces the grinding machine.

As is indicated in FIG. 2 and is once again brought out in an enlarged manner in FIG. 3, the two retaining elements 7 and 8 enclose the carrier element 3 in a non-positive and/or positive fit. The non-positive fit fastening is effected by way of screwing through threads 13 mounted on the retaining elements 7, 8. The fixation of the carrier element 3 to the grinding machine is effected by way of mechanical tools which may engage into the drill holes 11 and 14.

The inner circumference of the carrier element may also e.g. be toothed or be provided with projections which engage into complementary surfaces of the retaining elements 7 and 8. In this manner also a positive locking between the retaining elements 7, 8 and the carrier element 3 may be achieved.

Figure 4:
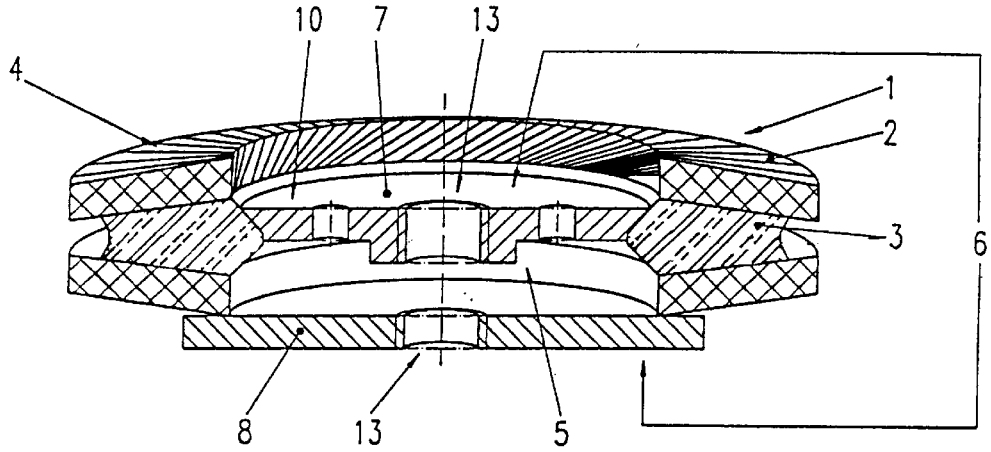

FIG. 4 shows a further embodiment form of the fastening device 6. The end face retaining element 10 with this is formed in the same manner as is shown in FIG. 2. The retaining element 8 which in FIG. 2 is unreleasably connected to the protective covering 12 is realised in FIG. 4 as a disk which does not achieve the diameter of the grinding body 1 and thus only serves as a counter bearing for the retaining element 10 with a fixation by way of a threaded rod 13.

Figure 5:
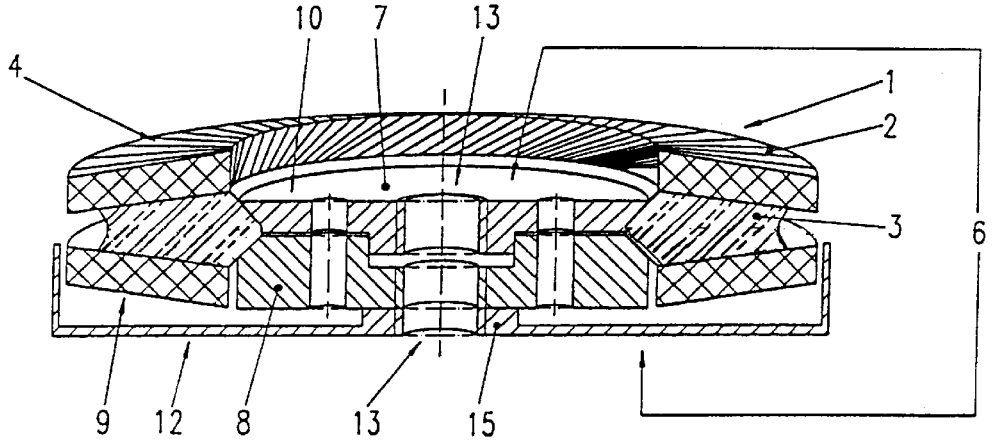

FIG. 5 shows the grinding body 1 according to FIG. 1, wherein the retaining element 8 is not connected to the protective covering 12. The protective covering 12 shown in FIG. 5 is a separate design and with a spacer 15 with the help of the thread 13 is fastened to the two retaining elements 7 and 8. Also with this embodiment form the end face of the fastening device 10 forms a disk with the grinding body 1 and the side 9 of the grinding body 1, which faces the grinding machine is protected by the protective covering 12.

These embodiment forms according to the invention permit the machining of weld joins, and are particularly suitable for edge grinding, deburring work and surface grinding, ideally for small surfaces, and for de-rusting.

What is claimed is:

1. In a grinding body comprising a carrier element having a first side and a second side opposite the first side, a first plurality of overlapping grinding blades arranged in a fan-like manner, fastened on a first side of the carrier element to form a first grinding surface, and a second plurality of overlapping grinding blades arranged in a fan-like manner, fastened on a second side of the carrier element to form a second grinding surface, the improvement wherein the grinding blades on opposite sides of the carrier element are overlapped in opposite circumferential directions when viewed in a direction perpendicular to an axis of the carrier element.

2. A grinding body according to claim 1, wherein the carrier element corresponds substantially to the whole shape of the grinding surfaces, and has a relief adapted for releasable engagement with a fastening device for fastening the grinding body to a drive motor.

3. A grinding body according to claim 1, wherein the grinding surfaces formed by the overlapping grinding blades and the carrier element are annular.

4. A grinding body according to claim 2, further comprising a protective covering attached to and completely covering a side of the grinding body facing the grinding motor.

5. A grinding body according to claim 2, wherein the fastening means comprises two parts.

6. A grinding body according to claim 2, wherein the fastening device comprises two retaining elements which are releasably connected to one another and which releasably enclose the carrier element between them, and wherein one of the two retaining elements is rigidly and permanently affixed to a protective covering for one side of the grinding body.

* * * * *